United States Patent [19]

Callihan et al.

[11] Patent Number: 4,479,544

[45] Date of Patent: Oct. 30, 1984

[54] PRESSURE ACTUATED PACK-OFF AND METHOD

[75] Inventors: Rudy B. Callihan; Bobby F. Goad; Gary A. Miller, all of San Antonio, Tex.

[73] Assignee: Baker Oil Tools, Inc., Orange, Calif.

[21] Appl. No.: 471,399

[22] Filed: Mar. 2, 1983

[51] Int. Cl.[3] ..... E21B 33/13

[52] U.S. Cl. ..... 166/290; 166/387; 166/153

[58] Field of Search ..... 166/290, 387, 383, 196, 166/156, 317, 318, 153, 285, 120; 277/27, 30, 31

[56] References Cited

U.S. PATENT DOCUMENTS

| | | | |
|---|---|---|---|
| 1,944,442 | 1/1934 | Manning | 166/156 |
| 2,621,742 | 12/1952 | Brown | 166/153 |
| 4,345,649 | 8/1982 | Baugh et al. | 166/387 X |

*Primary Examiner*—James A. Leppink
*Assistant Examiner*—Thuy M. Bui
*Attorney, Agent, or Firm*—Norvell & Associates

[57] ABSTRACT

Mechanism for achieving the radial expansion of an annular elastomeric pack-off unit between the bore of a casing and the exterior of a liner, comprises a tubular sealing assembly threadably connected between the liner and the hanger and defining two inwardly projecting annular seals, an annular fluid pressure chamber, and radially disposed fluid inlet ports for the fluid pressure chamber located between the two inwardly projecting annular seals. An annular piston mounted in the annular pressure chamber effects the compressible expansion of an annular elastomeric seal element. A tubing extension of the work string is provided which may be selectively moved into sealing relationship with either or both of the internally projecting annular seals. During the cementing operation, the tubing extension engages both annular seals. After cementing, the tubing extension may be elevated by the work string to disengage from the lowermost one of the internally projecting annular seals and permit fluid pressure to be applied through the radial ports to the actuating piston. A backup or alternate method of operation is provided through the incorporation of radial ports in the work string pipe extension which are normally covered by a valve sleeve shearably secured to the pipe extension.

21 Claims, 7 Drawing Figures

PRESSURE ACTUATED PACK-OFF AND METHOD

BACKGROUND OF THE INVENTION

1. Field of the Invention: The invention relates to a fluid pressure actuated pack-off for sealing the annulus between a casing and a hanger supported liner after completion of a liner cementing operation.

2. Description of the Prior Art: It is a common practice in subterranean wells, particularly in wells of significant depth, to extend the main casing only a portion of the distance into the well and then provide a liner hanger for supporting a smaller diameter liner extending to the lower portions of the well. It is also desirable that the liner be cemented in the well bore. For this reason, the hangers normally employed to suspend liners within a well bore are not provided with fluid pressure actuated pack-off device would be highly desirable in such applications, but the practical difficulties of isolating the fluid pressure responsive portions of the device from the cementing fluid during the cementing operation and then achieving reliable operation of the fluid pressure actuated pack-off after the cementing operation, have not heretofore been overcome. Moreover, it is highly desirable that the fluid pressure actuated pack-off be carried into the well in the same trip with the liner, the hanger, and other elements commonly employed for effecting the cementing of the liner in the well bore.

SUMMARY OF THE INVENTION

The invention provides a fluid pressure actuated pack-off consisting primarily of a tubular seal supporting assembly threadably connected between the top portions of the liner and the lower portions of the hanger by which the liner is suspended from the casing. The hanger may be any conventional type, such as the Model A Simplex Liner Hanger, Product No. 261-01, sold by BAKERLINE DIVISION of BAKER OIL TOOLS, INC. of San Antonio, Tex. The liner, the tubular sealing assembly, the hanger, and a conventional hydraulic actuated setting tool for the liner, such as the Hydraulic Running Tool, Product No. 266-01, sold by the aforesaid BAKERLINE DIVISION, are all carried into the well on a work string. The hanger is set at the desired position in conventional fashion through the application of fluid pressure to the hydraulic running tool.

The tubular sealing assembly comprises a pair of internally projecting, axially spaced annular sealing elements which are sealingly engageable with an external cylindrical sealing surface provided on a tubing which constitutes an extension of the bore of the work string. The length of the exterior cylindrical sealing surface is such that it may be positioned to selectively engage either or both of the internally projecting annular seals.

The sealing assembly further includes an annular fluid pressure chamber disposed intermediate the two internally projecting annular seals and having a radially disposed fluid port communicating with the bore of the liner. The sealing of the annulus between the liner and the casing is accomplished by an annular elastomeric member which is compressibly expandable, through the application of an axial force, into sealing engagement with the interior bore of the casing and an exterior surface of the sealing assembly. An annular piston cooperates with the annular fluid pressure chamber and, when fluid pressure is applied to such fluid pressure chamber, the piston moves axially to apply the required axial compressive force to the annular elastomeric element to achieve the pack-off. A conventional lock ring effects the locking of the piston in its pack-off producing position.

During the run-in of the apparatus, the pipe extension of the work string is positioned so that the cylindrical sealing surface is engaged only with the lower one of the two axially spaced, internally projecting sealing elements. This prevents the trapping of atmospheric pressure between the two sealing elements during run-in. After setting of the hanger, the tubing extension is elevated by the work string to a position wherein both of the internally projecting seal elements are engaged by the exterior sealing surface on the extension tubing. In this posiiton, cementing fluid can be passed through the work string and the pipe extension and the cementing of the lower portions of the liner accomplished in conventional fashion without any danger of the cementing fluid passing into the fluid pressure actuating chamber for the pack-off unit.

At the conclusion of the cementing operation, the wiping of the bores of the liner and the drill pipe are respectively accomplished by an annular wiping plug, which is shearably secured to the bottom end of the extension tubing, and by a solid wiping plug which is forced downwardly through the work string by applied fluid pressure. When the solid wiping plug contacts the annular sealing plug, it effects a seal with a sealing surface provided on the periphery of the solid wiping plug which engage a receptacle provided in the bore of the annular wiping plug to effect the latching of the two plugs together in sealed relationship. Such seal permits pressure to be built up above the solid plug sufficient to effect the shearing release of the annular wiping plug, and the two plugs travel together down the liner assembly, effecting the wiping of the liner bore until they reach the bottom of the liner assembly at which point a conventional latch mechanism on the bottom of the annular wiping plug is engaged in a conventional latch receptacle.

After completion of the wiping operations, the extension tubing may be elevated so that the lower one of the two axially spaced, internally projecting seals is no longer engaged with the exterior sealing surface on the tubing, thus permitting fluid pressure to pass upwardly around the bottom end of the tubing and into the radial port to supply actuating fluid pressure to the actuating piston. The resulting axial movement of the actuating piston effects an expansion of the annular elastomeric pack-off unit into sealing relationship across the annulus between the casing bore and the liner exterior. The piston is locked in this position by a conventional ratcheting body lock ring.

In the event that an imperfect fluid seal is provided between the annular and the solid wiping plugs, this invention provides a backup mechanism for insuring that the annular actuating piston may be supplied with fluid pressure. Such backup mechanism comprises a radial port in the wall of the extension tubing which is normally covered by a valve sleeve which is shearably secured in such position. The valve sleeve is provided with an upwardly facing valving surface and the dropping of a plug type or ball valve on such surface will effect a sealing of the extension pipe bore at a position above the location of the cooperating wiper plugs. The extension tubing is then positioned in concurrent engagement with both of the inwardly projecting sealing elements and fluid pressure is applied through the work string to the bore of the tubing. Such fluid pressure effects a shearing of the pins holding the valve sleeve in its port covering position and permits the sleeve to be moved downwardly, thus uncovering the valve port. Fluid pressure can then flow through the uncovered valve port into the regular fluid supply ports for the annular pressure chamber and thus the annular piston is shifted axially to compressibly expand the annular elastomeric pack-off element.

DESCRIPTION OF THE PREFERRED EMBODIMENT

Figure 1A:
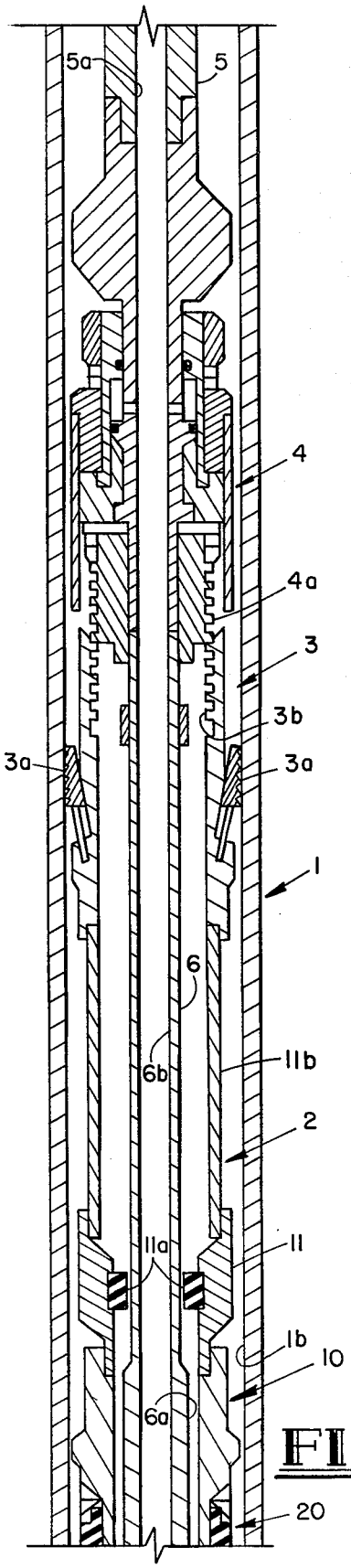
FIGS. 1A and 1 collectively constitute a vertical sectional view of a fluid pressure actuated pack-off device incorporating this invention shown in the run-in position in a well casing.
Figure 1E:
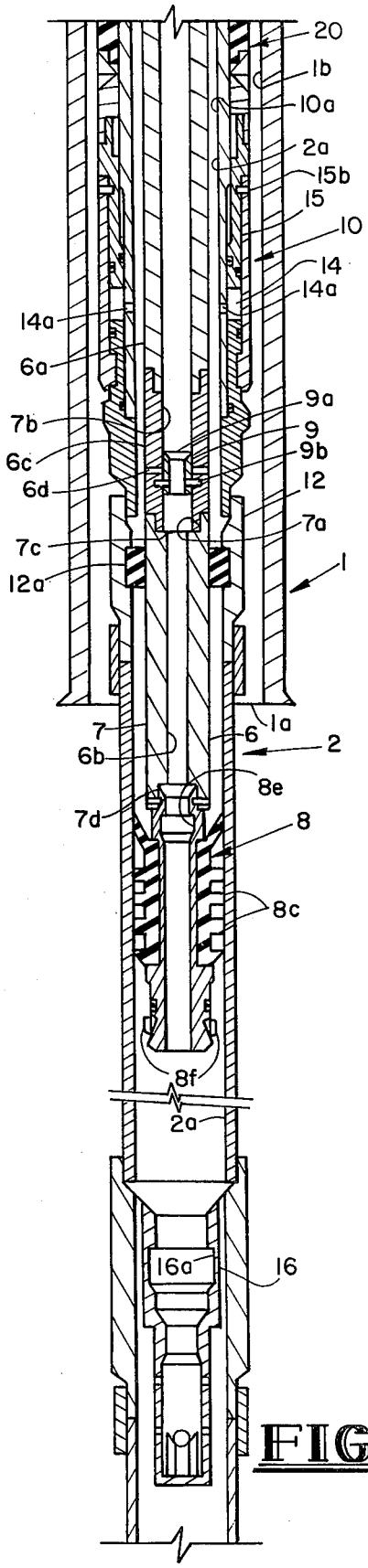

Referring to FIGS. 1A and 1B, there is shown a casing 1 conventionally mounted in a well bore and having an open bottom end 1*a*. A tubular liner assemblage liner 2 is suspended in casing 1 by a conventional hanger 3, which may be either hydraulically or mechanically actuated, such as the BAKERLINE MODEL A SIMPLEX LINER HANGER, Product No. 261-01, sold by BAKERLINE DIVISION of BAKER OIL TOOLS, INC. of San Antonio, Tex. The hanger 3 is run into the well and set by a conventional running and setting tool 4 which may comprise the BAKERLINE HYDRAULIC RUNNING TOOL, Product No. 266-01, sold by aforementioned BAKERLINE DIVISION. The running-in and setting tool 4 is in turn suspended from a work string 5. In some applications, it may be desirable to incorporate an expansion joint (not shown) between the running and setting tool 4 and the work string 5. In FIG. 1, this assemblage is shown in the run-in position in the well and with the hanger slips 3*a* expanded into engagement with the bore of the casing 1. Additionally, the running and setting tool 4 has its left hand threads 4*a* disengaged from the corresponding threads 3*b* of the hanger 3 so that vertical movement of the work string 5 relative to the set hanger 3 is possible.

In accordance with this invention the sealing of the annulus defined between the top outer portions of the liner 2 and the lower portions of the bore 1*b* of the casing 1 is accomplished by an expandable elastomeric pack-off unit 20 which is mounted in surrounding relationship to a tubular sealing assembly 10. The tubular sealing assembly 10 further includes at each end bushings 11 and 12, which respectively provide mounting for internally projecting annular seals 11*a* and 12*a*. These seals are mounted in axially spaced relationship to the expandable elastomeric pack-off unit 20. Bushing 11 threadably connects to space out sleeve 11*b* which in turn is supported by hanger 3. Bushing 12 connects to the top of liner assembly 2.

The elastomeric pack-off unit 20 is expandable by an axial force applied by an annular piston 15 which is mounted within an annular fluid pressure chamber 14 defined within the tubular assemblage 10. A fluid supply port 14*a* for chamber 14 connects the bore 2*a* of the liner assembly 2 with the chamber 14. It should be specifically noted that the fluid supply port 14*a* is located intermediate the two inwardly projecting annular seals 11*a* and 12*a*. The sealing elements 11*a* and 12*a* are preferably formed of drillable material so that they can be removed after completion of the setting and packoff operations, if desired.

A tubular extension 6 of the work string 5 is provided in the form of a pipe having an enlarged diameter cylindrical sealing surface 6*a* formed on its lower portions. The axial length of the sealing surface 6*a* is such as to more than span the distance between the internal projecting seals 11*a* and 12*a*, so that the sealing portion 6*a* may be selectively brought into engagement with either one or both of the internally projecting seals 11*a* and 12*a* by vertical movements of workstring 5. At the bottom end of the work string extension tubing 6, a liner wiper support sleeve 7 is conventionally secured by threads 7*a*. The exterior diameter of the liner wiper support sleeve 7 is the same diameter as the sealing surface 6*a* but the bore 7*b* of such element is slightly smaller than the diameter of the work string extension tubing 6 so as to define an upwardly facing shoulder 7*c* (FIG. 2) for a purpose to be hereinafter described. The lower end of the support sleeve 7 defines a counter bored surface 7*d* for receiving corresponding cylindrical surface 8*a* of an annular liner wiping plug 8. Shear pins 8*b* hold the annular liner wiping plug 8 in assembled relationship to the support sleeve 7.

The annular liner wiper plug 8 is provided with conventional peripherally extending elastomeric flanges 8*c* which are proportioned to effect a wiping of the bore 2*a* of the liner 2 after the passage of the cementing fluid therethrough. Additionally, the bore 8*d* of the annular wiping plug 8 is recessed as indicated at 8*e* to provide a latching recess for radially projecting latches provided on a solid work string wiping plug 40 to be hereinafter described. Externally projecting latch 8*f* is also provided on annular wiping plug 8.

That portion of the tubular extension 6 defining the sealing surface 6*a* also incorporates a section 6*c* having a radial port 6*d* therethrough. This port is normally closed by an overlying sleeve valve 9 having an upwardly facing annular sealing surface 9*a* and is secured to the tubular portion 6*c* by shear pins 9*b*. As will be later described, when a ball 50 (FIG. 5) is dropped into sealing engagement with the upwardly facing shoulder 7*c* and pressure is applied to shear pins 9*b*, sleeve valve 9 is moved downwardly, thus opening communication from the bore of the work string 5 to the bore 10*a* of the tubular sealing assembly 10 through the radial port 6*d*.

Adjacent the bottom portions of the liner assembly 2, a conventional landing collar 16 (FIG. 1B) is mounted and defines a latching recess 16*a* for reception of externally projecting latches 8*f* provided on the bottom end of the liner wiping plug 8. Normally the landing collar 16 is disposed below the anticipated production zones of the well.

Below the landing collar 16, a cement float shoe may be connected in the tubular liner assemblage. Since such apparatus is entirely conventional and forms no part of this invention, it has not been illustrated in the drawings.

Figures 4, 4A:
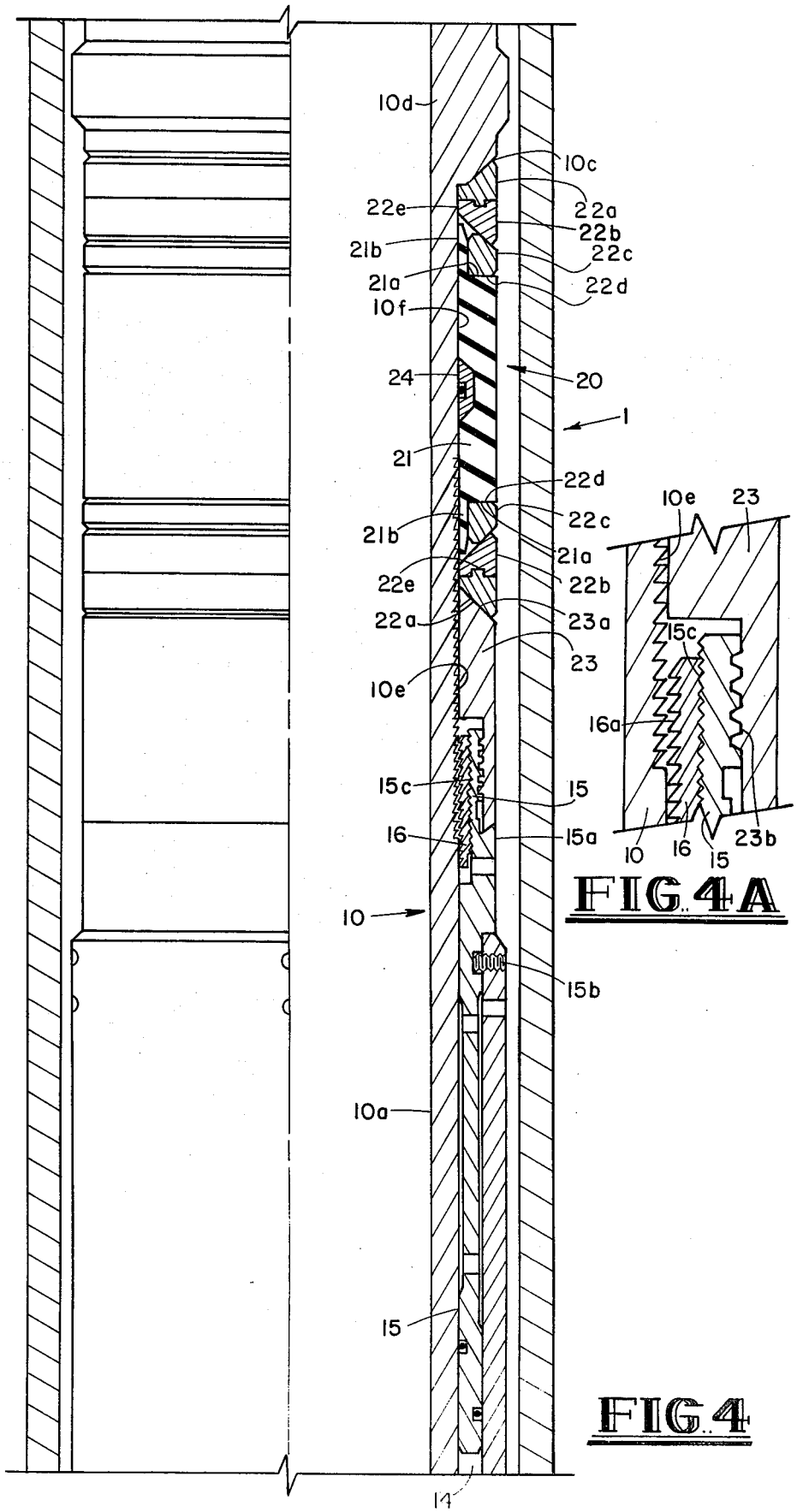
FIG. 4 is an enlarged scale view of the expandable pack-off and its actuating piston.
FIG. 4A is a greatly enlarged view of a portion of FIG. 4.

Referring now to the enlarged scale view of the expandable elastomeric pack-off unit 20 shown in FIG. 4, it will be seen to comprise an annular elastomeric mass 21 disposed intermediate two sets of identical compression ring elements 22*a*, 22*b*, and 22*c*. The rings 22*c*, which respectively abut opposite axial ends of the elastomeric mass 21, are solid and are provided with radial surfaces 22*d* respectively abutting radial shoulders 21*a* on the elastomeric mass 21. The two outer rings 22*a* and 22*b* are both split and are secured for concurrent expansion movement by an annular tongue and groove connection 22*e*.

The upper set of compression rings are cammed downwardly and outwardly by a downwardly facing inclined surface 10*c* formed on the top portion of the body 10*d* of the tubular seal assembly 10. The lower set of compression rings are cammed upwardly and outwardly by an upwardly facing inclined surface 23*a* provided on a force transmitting sleeve 23, which is secured to the top extension portion 15*a* of the annular piston 15 by threads 23*b* (FIG. 4A). If desired, an O-ring sleeve mounting 24 may be provided in the inner surface of the annular elastomeric mass 21 to insure sealing engagement with the exterior cylindrical surface 10*f* of the tubular body 10*a*. In any event, the exertion of an upward axial compression force on the expansion ring elements 22*a*, 22*b*, and 22*c* by the annular piston 15 will effect an axial compression and a radially inward and outward expansion of the annular elastomeric mass 21, thereby effecting a seal or pack-off between the exterior of the liner assembly 2 and the interior bore 1*b* of the casing 1. It should be particularly noted that the split compression rings 22*a* and 22*b* move radially outwardly during such compression of the annular elastomeric mass 21 and hence reduce the clearance available for axial extrusion of such mass around the compression rings.

The annular upward extension 15*a* of piston 15 is provided with internal threads 15*c* which engage corresponding threads provided on a conventional body lock ring 16, having internal threads cooperating with ratchet or wicker type threads 10*e* provided on the tubular body 10*a* of the tubular sealing assembly 10 to lock the piston 15 as its uppermost point of advancement by the applied fluid pressure, thus assuring that compressive forces applied to the expandable elastomeric packoff unit 20 are effectively trapped in the unit.

Figure 2:
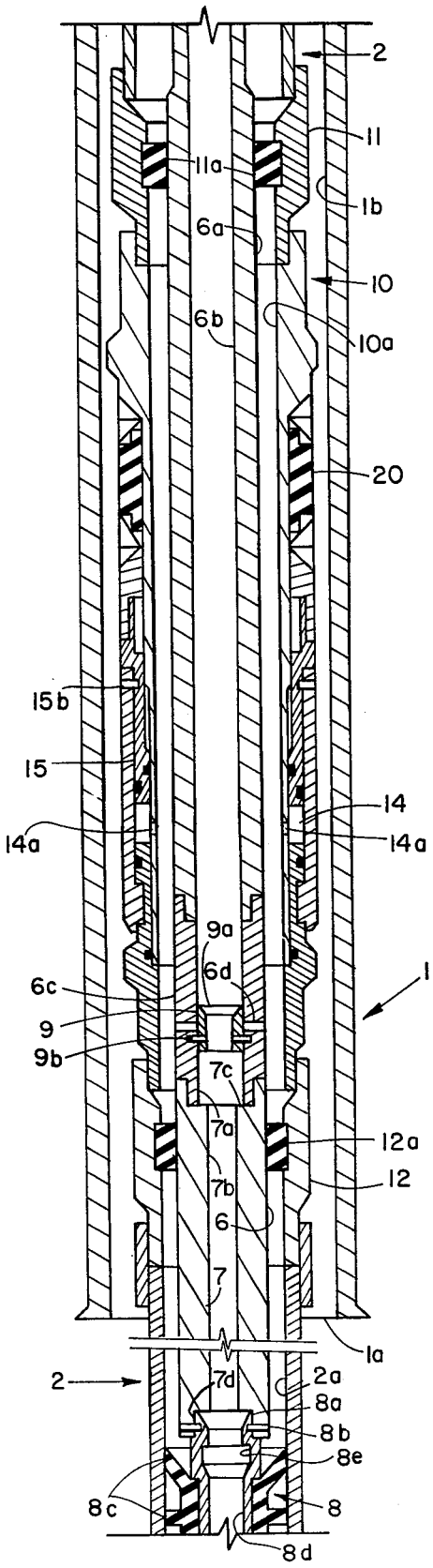
FIG. 2 is an enlarged view of that portion of FIG. 1B which illustrates the tubular sealing assembly, with the components positioned for the cementing operation.
Figure 3:
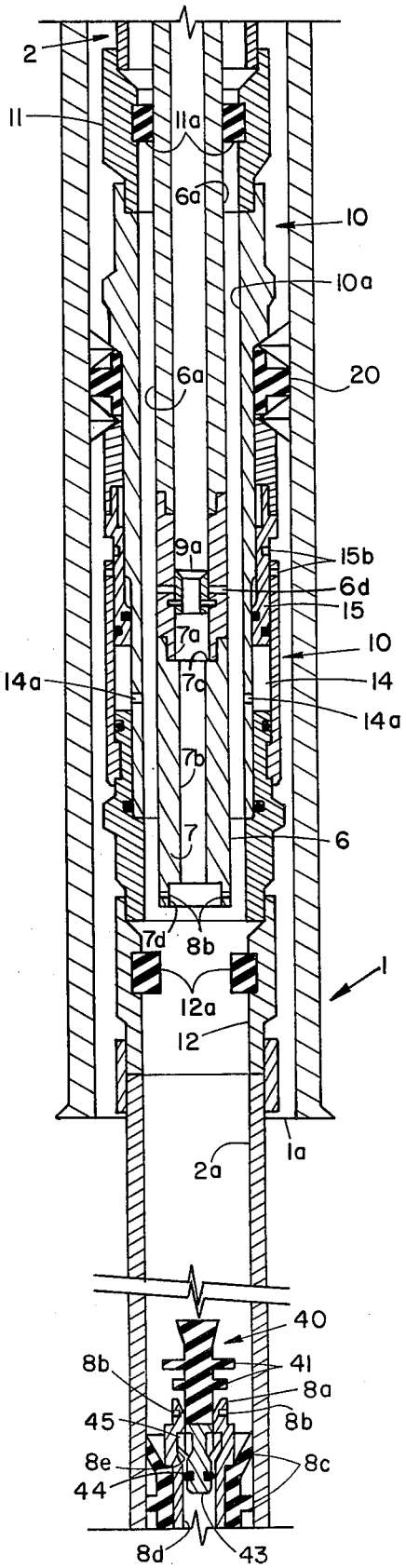
FIG. 3 is a view similar to FIG. 2 but showing the tubular sealing assembly components in the positions occupied after the bore wiping operation.

The operation of the aforedescribed apparatus may be readily understood by reference to FIGS. 2 and 3. As previously mentioned, in FIGS. 1A and 1B the components of the apparatus are shown in their run-in position with the hanger 3 set and in engagement with casing 1 and hydraulic running and setting tool 4 threadably disengaged from the hanger unit 3. During run-in, piston 15 is retained in an inoperative position by one or more radial shear pins 15*b*. The work string 5 is then elevated to bring the sealing surface 6*a* on the work string extension 6 into simultaneous engagement with both of the internally projecting seals 11*a* and 12*a*. Thus, the fluid supply port 14*a* for the fluid pressure chamber 14 is effectively isolated from the bore 5*a* of the work string. Cementing fluid may then be applied through the open bore 5*a* of the work string and forced downwardly to the bottom end (not shown) of the liner assembly 2 to flow outwardly and upwardly around such bottom end to anchor the liner in the well bore. At the conclusion of the cementing operation, a conventional solid wiping plug 40 (FIG. 3) is inserted within the bore 5*a* of the work string and pumped downwardly by drilling mud or other suitable fluid, thus forcing the cement out of the drill pipe and wiping the bore 5*a* of the drill pipe and bore 6*b* of the work string extension 6 by virtue of the cooperation of peripherally extending elastomeric wiping flanges 41 conventionally provided on the solid plug 40.

Plug 40 is therefore moved downwardly until the bottom end portion 43 carrying seals 44 sealably engages in the bore 8*d* of the annular liner wiper plug 8 and is retained in such sealed position through the cooperation of the exteriorally projecting latch 45 with the latching recess 8*e* provided on the annular wiping plug 8. The continued application of fluid pressure through the work string 5 will cause a shearing of shear pins 8*b* and permit the now interconnected wiper plugs 40 and 8 to move downwardly through the liner assembly 2, wiping the bore surface 2*a* thereof free of cement until the annular wiping plug 8 seats in the landing collar 16 provided at the bottom end of the liner assembly 2. At this point, pressure can be built up in the bore of the work string 5, assuming that a good seal has been made between the annular wiping plug 8 and the landing collar 16, and also between the solid wiping plug 40 and the annular wiping plug 8. As the fluid pressure is increased, the work string 5 is elevated, as shown in FIG. 3, so as to bring the cylindrical sealing surface 6*a* upwardly out of engagement with the lower internally projecting seal 12*a*. The pressured fluid is then permitted to move through the port 14*a* into the fluid pressure chamber 14 where it exerts an axial upward force on the actuating piston 15, shearing pins 15*b* to move upwardly, and thus compressing the expandable elastomeric pack-off unit 20 and achieving a sealing of the annulus between the casing bore 1*b* and the exterior surface 10*f* of the liner assembly 2.

Figure 5:
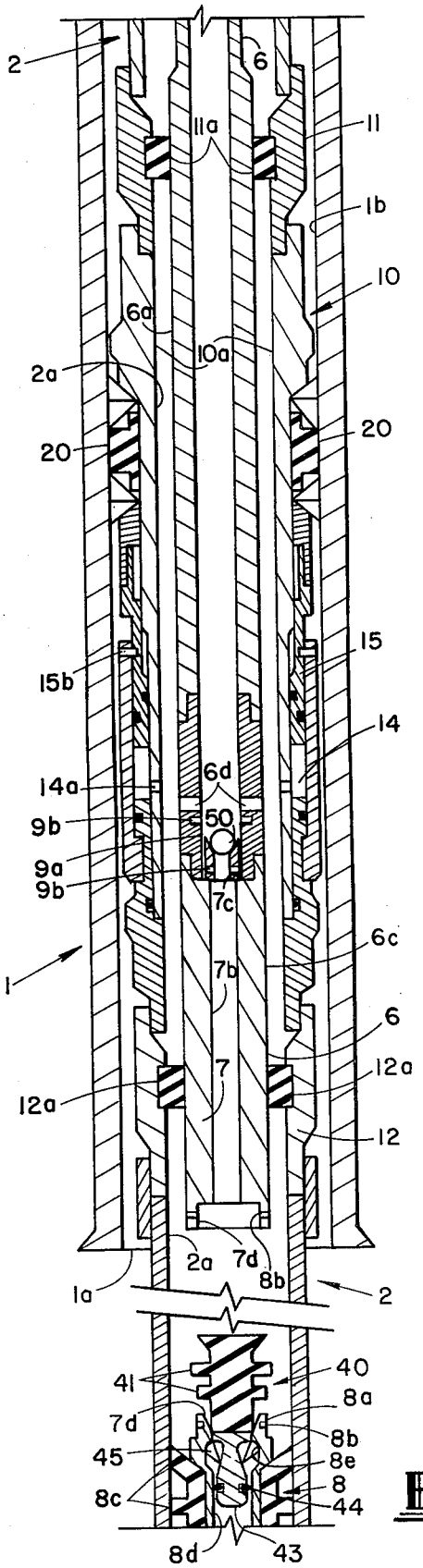
FIG. 5 is a view similar to FIG. 3 but illustrating the fluid pressure actuation of the pack-off device by utilization of a secondary mechanism for effecting the sealing of the work string bore.

In the event that a perfect seal is not achieved between the solid wiping plug 40 and the annular wiping plug 8, or between the annular wiping plug 8 and the landing collar 16, this invention provides an alternate or backup mechanism for effecting the fluid pressure operation of the piston 15 to expand the annular elastomeric pack-off unit 20. Referring to FIG. 5, a ball or other type of plug valve 50 is dropped through the bore of the work string 5 to seat in sealing relationship upon the upwardly facing sealing surface 9*a* provided on the valve sleeve 9. A further increase in fluid pressure provides a shearing of the shear pins 9*b* and a downward displacement of the valve sleeve 9 to open the radial ports 6*d*. With the sealing surface 6*a* of the drill pipe extension 6 positioned in concurrent engagement with both of the internally projecting seals 11*a* and 12*a*, pressured fluid can then flow through the open ports 6*d* into the annulus between the work string extension 6 and the bore 10*a* of the tubular sealing assembly 10 to enter the fluid pressure chamber 14 through the radial ports 14*a*. Thus, operation of the actuating piston 15 in the manner heretofore described can be accomplished.

After achieving the expansion of the elastomeric pack-off unit 20, the work string 5 may be withdrawn to remove the work string, the run-in and setting tool 4 and the work string extension pipe 6 from the well, leaving the liner 2 and the rigidly interconnected tubular sealing assembly 10 supported in the well by the hanger 3.

Those skilled in the art will recognize that it is not necessary to rely upon the sealing achieved through the cooperation of the solid wiping plug 40 with the annular wiping plug 8 and in turn with the landing collar 16. Thus, the step of applying pressure to the bore of the work string after driving the solid wiping plug 40 into engagement with annular plug 8 and the resultant assemblage into engagement with the landing collar 16 may be omitted. Instead, without moving the work string 5, the plug type valve or ball 50 may be immediately dropped into sealing engagement with the valve sleeve 9 and the fluid pressure within the work string 5 increased to effect a shearing of the shear pins **9*b* and downward movement of the valve sleeve 9 to open communication with fluid pressure chamber 14 through the ports 6*d*. Thus, the shearable valve sleeve 9** provides either an alternate method of operation or a backup method depending on the desires of the operator.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for sealing the casing annulus defined between the bore of a well casing and a hanger supported liner subsequent to a cementing operation comprising, in combination: a tubular seal mounting assembly connectable between the liner hanger and the upper portion of the liner above the cementing zone; said tubular assembly comprising:

(1) an annular pack-off unit radially expandable into sealing engagement with said casing annulus in response to an applied axial compressive force;
(2) a pair of vertically spaced, internally projecting, annular seals;
(3) an annular fluid pressure chamber having a fluid supply port intermediate said annular seals; and
(4) an annular piston movable within said fluid pressure chamber to exert an axial compression force on said pack-off unit to seal said annulus;

a tubular extension extending through said tubular assembly; said tubular extension having a cylindrical external surface selectively sealingly engageable with either or both of said internally projecting annular seals by vertical movement of said tubular extension, whereby cementing fluid may be passed through said tubular assembly by engaging said cylindrical external surface of the tubular extension with both of said internally projecting annular seals; means defining an annular valve seat in the liner below the lower one of said internally projecting annular seals; and a plug type valve element insertable through said tubular extension into seating engagement with said annular valve seat; whereby application of fluid pressure through said tubular extension subsequent to cementing and raising said tubular extension out of sealing engagement with only the lower one of said internally projecting annular seals will supply fluid pressure to said annular piston through said fluid supply port.

2. The apparatus of claim 1 wherein said plug type valve comprises a central plug sealingly engageable with said annular valve seat and radially projecting elastomeric flanges mounted on said, central plug and having wiping engagement with the bore of said tubular extension.

3. The apparatus of claim 2 wherein said annular valve seat is defined by an annular liner bore wiping plug shearably secured to the bottom end of said tubular extension and positioned below said lower one of said internally projecting annular seals during run-in and the cementing operations; said liner wiping plug being shiftable downwardly to wipe the exposed liner bore by fluid pressure applied through said tubular extension after said plug type valve is seated; and latching means in the lower portion of the liner for anchoring said liner wiping plug.

4. The apparatus of claim 3 further comprising a latch mounted on the periphery of said plug type valve element, and a latch receptacle formed in the bore of said annular liner bore wiping plug for securing said plug type valve element in sealing realtionship with said annular valve seat.

5. The apparatus of claim 1 further comprising a second annular valve seat shearably mounted in said tubular extension above said first annular valve seat; said second annular valve seat having an internal diameter sufficient to permit free passage of said plug type valve therethrough; said second annular valve seat being sealable by a valving element dropped through the work string, thereby permitting pressurization of the work string and said tubular extension in the event the seal at said first annular valve seat is defective, and radial port means in said tubular extension openable by downward movement of said second annular valve seat relative to the liner to communicate with said fluid support port; said tubular extension being shifted downwardly into sealing engagement with both said internally projecting annular seals to isolate said first annular valve seat from fluid pressure in the work string.

6. The apparatus of claim 1 further comprising means for locking said annular piston in its pack-off compressing position.

7. The apparatus of claim 1 wherein said annular pack-off unit comprises an annular mass of elastomeric material and a set of compression rings abutting each axial end of the annular elastomeric mass; each said set including an abutting pair of axially split metallic rings, the abutting surfaces of said split rings being radial and the non-abutting surfaces being oppositely inclined, whereby an axial compressive force applied to opposite ends of the elastomeric mass through said compression rings produces concurrent axial and radially outward movement of said sets of compression rings to match the displacement of said annular elastomeric mass.

8. The apparatus of claim 7 wherein each said set of compression rings includes a solid ring having a radial face abutting a radial shoulder on said annular elastomeric mass and an inclined face abutting an inclined face of the respective pair of split rings.

9. Apparatus for sealing the casing annulus defined between the bore of a well casing and a hanger supported liner subsequent to a cementing operation comprising, in combination: a tubular seal mounting assembly connectable between the liner hanger and the upper portion of the liner above the cementing zone; said tubular assembly comprising:

(1) an annular pack-off unit radially expandable into sealing engagement with said casing annulus in response to an applied axial compressive force;

(2) a pair of vertically spaced, internally projecting, annular seals;

(3) an annular fluid pressure chamber having a fluid supply port intermediate said annular seals, and (4) an annular piston movable within said fluid pressure chamber to exert an axial compression force on said pack-off unit to seal said annulus;

a work string carried tubing extension extending through said tubular assembly; said tubing extension having a cylindrical external surface selectively sealingly engageable with either or both of said internally projecting annular seals by vertical movement of said tubing extension, whereby cementing fluid may be passed through said tubular assembly by engaging said tubing extension with both of said internally projecting annular seals; said tubing extension having a radial port therein normally positioned intermediate said pair of internally projecting, annular seals; a valve sleeve shearably secured within said tubing extension in overlying relationship to said radial port; said valve sleeve defining an upwardly facing, annular valve seat constructed and arranged to be sealed by a plug valve dropped through said tubing extension, whereby application of fluid pressure through said tubing extension will shift said valve sleeve downwardly to open said radial port and actuate said annular piston.

10. The apparatus of claim 9 further comprising means for locking said annular piston in its pack-off compressing position.

11. The apparatus of claim 9 further comprising an annular wiper plug shearably secured to the bottom portion of said tubing extension; said annular wiper plug having circumferential elastomeric wiping flanges engageable with the liner bore and an annular valve seat; a solid wiping plug droppable through said tubing extension and valve sleeve prior to insertion of said plug valve; said solid wiping plug being insertable in said tubing extension after cementing and having circumferential elastomeric wiping flanges engageable with the bore of the work string and said tubing extension and a central plug portion sealingly engageable with said annular valve seat on said annular wiping plug, whereby the application of fluid pressure to the inserted said solid wiping plug after cementing produces a wiping of the bores of the work string, said tubing extension, and said liner.

12. The apparatus of claim 11 further comprising a latch mounted on the periphery of said solid wiping plug, and a latch receptacle formed in the bore of said annular wiping plug for securing said solid wiping plug in sealing relationship with said annular valve seat.

13. The apparatus of claim 9 wherein said annular pack-off unit comprises an annular mass of elastomeric material and a set of compression rings abutting each axial end of the annular elastomeric mass; each said set including an abutting pair of axially split metallic rings; the abutting surfaces of said split rings being radial and the non-abutting surfaces being oppositely inclined, whereby an axial compressive force applied to opposite ends of the elastomeric mass through said compression rings produces a concurrent axial and radially outward movement of said sets of compression rings to match the displacement of said annular elastomeric mass.

14. The apparatus of claim 13 wherein each said set of compression rings includes a solid ring having a radial face abutting a radial shoulder on said annular elastomeric mass and an inclined face abutting an inclined face of the respective pair of split rings.

15. The method of cementing a well liner and expanding an annular pack-off element into sealing engagement between the casing bore and the exterior of a liner supported within the casing, said annular pack-off element being expandable by an axially shiftable annular fluid pressure actuator having a radial fluid supply port disposed intermediate two axially spaced, internally projecting annular seals, comprising the steps of:

(1) inserting a work string supported tubing extension within the liner bore and in sealing engagement with both of said internally projecting annular seals;

(2) passing cementing fluid downwardly through the work string and tubing extension to cement the bottom portions of said liner;

(3) introducing a plug type valve through the work string and pipe to seat on an annular valve seat in said liner located below said radial port;

(4) axially shifting said tubing extension to break the sealing enagement with only the lower one of said internally projecting annular seals; and (5) applying fluid pressure through the work string, tubing extension, and radial port to said annular actuator, thereby expanding said annular pack-off element.

16. The method of claim 15 further comprising the step of locking said annular actuator in its pack-off expanding position.

17. The method of cementing a well liner and expanding an annular pack-off element into sealing engagement between the casing bore and the exterior of a liner supported within the casing bore and the exterior of a liner supported within the casing, said annular pack-off element being expandable by an axially shiftable annular fluid pressure actuator having a radial fluid supply port disposed intermediate to axially spaced, internally projected annular seals, comprising the steps of:

(1) inserting a work string supported tubing extension within the liner bore and in sealing engagement with both of said internally projecting annular seals; said tubing extension having a radial port located intermediate said internally projecting annular seals and a valve sleeve shearably secured to said tubing extension in overlying relationship to said radial port;

(2) passing cementing fluid downwardly through the work string and tubing extension to cement the bottom portions of said liner;

(3) dropping a plug type valve through the work string and tubing extension to seat on said valve sleeve in sealing relationship; and (4) applying fluid pressure through the work string and the tubing extension to shift the valve sleeve to expose the radial port in the tubing extension and supply fluid pressure to said annular actuator, thereby expanding said annular pack-off element.

18. The method of claim 17 further comprising the step of locking said annular actuator in its pack-off expanding position.

19. The method of cementing a well liner and expanding an annular pack-off element into sealing engagement between the casing bore and the exterior of a liner assembly supported within the casing, said annular fluid pressure actuator having a radial fluid supply port disposed intermediate two axially spaced, internally projecting annular seals, comprising the steps of:

(1) inserting a work string supported tubing extension within the liner bore and in sealing engagement with both of said internally projecting annular seals;

(2) passing cementing fluid downwardly through the work string and tubing extension to cement the bottom portions of said liner;

(3) wiping the bore surfaces of the pipe and liner;

(4) exposing the radial fluid supply port to communication with the bore of the tubing extension; and (5) applying fluid pressure through the work string and tubing extension to the annular actuator to shift same to expand the annular pack-off element.

20. The method of claim 19 further comprising the step of locking said annular actuator in its pack-off expanding position.

21. The method of claim 19 wherein step 4 is accomplished by raising the tubing extension above the lower one of said internally projecting annular seals.

* * * * *